United States Patent [19]

Grilli et al.

[11] 4,419,152

[45] Dec. 6, 1983

[54] PROCESS FOR DIRECT HEAT TREATMENT OF TRACK LINKS FOR TRACTORS OR TRACKED VEHICLES

[75] Inventors: Walter Grilli; Franco De Meo; Ivan Franchini, all of Modena, Italy

[73] Assignee: Italtractor ITM S.p.A., Castel Vetro, Italy

[21] Appl. No.: 388,715

[22] Filed: Jun. 15, 1982

[30] Foreign Application Priority Data

Jul. 21, 1981 [IT] Italy ..... 48934 A/81

[51] Int. Cl.[3] ..... C21D 8/00

[52] U.S. Cl. ..... 148/12 F; 148/12.3; 148/36

[58] Field of Search ..... 148/12 R, 12 F, 12.4, 148/12.1, 36, 12.3, 144; 75/126 P, 126 R, 123 D

[56] References Cited

U.S. PATENT DOCUMENTS 3,227,586 1/1966 Spencer ..... 148/145

FOREIGN PATENT DOCUMENTS 52-72318 6/1977 Japan ..... 148/143
55-97455 7/1980 Japan ..... 75/126 P
56-87652 7/1981 Japan ..... 75/123 L
645977 2/1979 U.S.S.R. ..... 75/124

*Primary Examiner*—Peter K. Skiff
*Attorney, Agent, or Firm*—Young & Thompson

[57] ABSTRACT

Process for the manufacture of steel track links for tracked vehicles, comprising forging steel track links at an initial forging temperature of 1150°–1200° C. for 45–60 seconds with a finish forging temperature of 950°–1050° C., subjecting the links thus-produced to initial cooling at a rate of 2°–4° C./s to a temperature of 720°–830° C., maintaining the links at a temperature of 800°–850° C. for 2–3 minutes, again cooling the links at a rate of 10°–15° C./s to a second temperature of 180°–380° C., and maintaining the links at this second temperature for a period of 10–20 minutes, the steel having the following weight percent compositions:

C: 0.30–0.38
Mn: 1.00–1.50
Cr: up to 0.60
Si: 0.15–0.35
S+P: about 0.06
balance essentially iron.

9 Claims, No Drawings

PROCESS FOR DIRECT HEAT TREATMENT OF TRACK LINKS FOR TRACTORS OR TRACKED VEHICLES

This invention relates to a process for direct heat treatment of track links for tractors and tracked vehicles in general, henceforth referred to simply as track links. More precisely, it concerns a process which exploits the residual forging heat of the links for their direct quenching and tempering without introducing heat or by the use of only small additional amounts of heat for process control.

As it is well known, track links are subject to very considerble wear and so they must be specially hard; furthermore, the service duty they have to perform is particularly severe, owing to the loads the links have to support, as a result of impact, jerky operation and temperature variations.

All this calls for good tensile strength, good impact strength and a low transition temperature. To endow the links with such properties, the treatment used in their manufacture is quite complex, not least because of their shape, with its many very different sections.

A classical method of forging and heat treatment for track links involves:

Heating the billet or the cropped billet to high temperature (about 1200° C.)

Forging the links

Air cooling

Heating to a temperature of about 850° C.

Quenching

Annealing at about 550° C.

During this process the link is heated three times (1200° C., 850° C. and 550° C.) and is cooled three times to room temperature.

The manufacturing process is thus discontinuous and costly. A continuous production cycle, on the other hand, offers undeniable technical advantages. Moreover, with today's high energy prices, production cycles such as that described above have become excessively costly. It has, therefore, become necessary to modify or replace such processes with less costly ones. However, it does not seem that this has happened so far with regard to the production of track links, or at least that there have been any radical changes; this situation is certainly attributable to the fact that these parts have to have special mechanical properties and also the fact that there geometrical form is quite complex. For parts of limited size and simpler geometry, as well as those which do not need to have all the mechanical properties required by track links, the use of direct quenching and tempering cycles has already been proposed. This process consists essentially in carrying out the whole of the heat treatment cycle at a relatively high temperature, so as to exploit the residual heat contained in the part after quenching (interrupted quenching) for the final annealing heating.

Initially these processes were kept separate from the forging of the parts. Subsequently, in the case of simple parts, the residual forging heat was used for quenching and tempering. Where the production of links was concerned, however, a process directly connected with the forging has never been successfully applied owing to the fact that the excess growth of grain size is favoured by soaking at the high forging temperatures, thus adversely affecting the mechanical properties.

Furthermore, the necessarily rapid cooling may cause breakage of the links, precisely because of the excessively large grain size and the geometry of the part.

The purpose of the present invention is to avoid these difficulties by eliminating at least one of the reheats in the traditional manufacturing cycle (that to 850° C.) and hence to exploit the residual heat for direct quenching and tempering.

This process is facilitated by the use of controlled grain steels, together with highly-automated plants for reheating the forging proper. These minimize the high-temperature holding times and hence the danger of grain size explosion.

According to the present invention, the steel for making the links, whose composition is in the following range (% wt):

C=0.30–0.38

Mn=1.00–1.50

Cr=0–0.60

Si=0.15–0.35

S+P=0.06

B=0.0005–0.003 (if desired)

is heated rapidly in induction furnace to a temperature of 1150°–1200° C. and then forged with a plurality of steps for a total time not exceeding 45–60 seconds, and a finish-forging temperature controlled between 950° and 1050° . C. The links are then cooled at a rate of between 2° and 4° C./s to a temperature of 830°–720° C., the quench temperature (800°–850° C.) being restored, if necessary, in a stabilizing tunnel, depending on the properties of the material being treated and the results to be obtained at the end of the heat-treatment cycle, namely UTS=95–115 kg/mm$^2$, KCV=5–7 kg from −40° to +40° C., austenitic grain=6–8 ASTM. The part is then cooled rapidly at a rate of 10°–15° C./s within the temperature range lying between the $M_s$ and $M_f$ values of the material (i.e. between about 180° and 380° C.), after which it is reheated and/or stabilized for 10–20 minutes at the temperature that furnishes the above tensile and impact values. Then the part is cooled in air or water to below the $M_f$ temperature.

At the second halt in the cooling process, small variations can be made to produce the type of structure it is wished to attain. If a mainly bainitic structure is desired, the second hold has to be made in the upper part of the $M_s$–$M_f$ range indicated, preferably between 300° and 380° C. for 10 to 20 minutes, after which, quenching is continued to room temperature and the links are ready for mechanical working. If it is desired to have a mainly annealed martensitic structure, the hold is made in the lower part of the $M_s$–$M_f$ range indicated, preferably between 180° and 250° C. for about 15 minutes, followed by a further rapid cooling stage to 130°–170° C., annealing from here directly at 530°–570° C. for 30 to 180 minutes.

Finally, there is the possibility of obtaining a mixed martensite plus bainite structure. In this case the second hold is made in the mid part of the range indicated, preferably between 250° and 300° C., for about 20 minutes, annealing from here directly at 480°–550° C. for 30 to 120 minutes.

The present invention will now be described further in relation to the following practical embodiments, which are cited purely by way of example and must in no way be considered as limiting the significance or the range of the invention.

EXAMPLE 1

A steel having the composition (% wt):

C 0.34; Mn 1.33; Si 0.32; Cr 0.2; B 0.003 was heated to 1150°-1200° C. and then forged in five positions in an automatic press for a time of 45 seconds; the finish forging temperature was 950°-1000° C. The links thus obtained were cooled at an average rate of 2°-4° C./s to a temperature of 830° C. and held there, with a tolerance of ±20° C. for 2 or 3 minutes. Cooling was then continued to 220° C. at a rate of 10°-15° C./s, and the links held at this temperature for 10-20 minutes. Cooling was subsequently continued to 150° C. At this temperature the links were transferred to an annealing furnace and treated at 560° C. for one hour. An annealed martensite structure was obtained. The grain was 6-8 ASTM and the UTS=100 kg/mm$^2$.

EXAMPLE 2

A steel having the composition (% wt):

C 0.33; Si 0.30; Mn 1.33; Cr 0.2; B 0.003 was heated to 1150°-1200° C. and then press forged in the same manner as above. The finish-forging temperature was 950°-1000° C. The links thus obtained were cooled to 830° C. at an average rate of 2°-4° C./s and held there for 2-3 minutes. Cooling was then continued at a rate of 10°-15° C./s to 350° C. where the parts were held for about 20 minutes, after which they were rapidly cooled to room temperature. A mainly bainite structure was obtained with 6-8 ASTM grain and a UTS of 105 kg/mm$^2$.

EXAMPLE 3

A steel having the composition (% wt):

C 0.33; Si 0.30; Mn 1.36; Cr 0.2; B 0.003 was treated as in Example 1 up to the 830° C. temperature stage. This temperature was held for 2-3 minutes. The links were then cooled at a rate of 10°-15° C./s down to 270° C. and held there for about 20 minutes. Finally the links were annealed at 520° C. for about 60 minutes. The structure was mixed bainite plus annealed martensite, with 6-8 ASTM grain and UTS of 102 kg/mm$^2$.

EXAMPLE 4

A steel having the composition (% wt):

C 0.35; Mn 1.32; Cr 0.32; Si 0.15 was treated as in Example 1 down to a temperature of 720° C. and was then taken back up to 830° C. and held there for 5 minutes, after which it was cooled rapidly at a rate of 15° C./s to the cycle temperatures envisaged in Examples 1, 2 and 3, with the following results: 6-8 ASTM grain, UTS of 102, 106 and 103 kg/mm$^2$, respectively.

We claim:

1. Process for the manufacture of steel track links for tracked vehicles, comprising forging steel track links at an initial forging temperature of 1150°-1200° C. for 45-60 seconds with a finish forging temperature of 950°-1050° C., subjecting the links thus-produced to initial cooling at a rate of 2°-4° C./s to a temperature of 720°-830° C., maintaining the links at a temperature of 800°-850° C. for 2-3 minutes, again cooling the links at a rate of 10°-15° C./s to a second temperature of 180°-380° C., and maintaining the links at said second temperature for a period of 10-20 minutes, the steel having the following weight percent compositions:

C: 0.30-0.38
Mn: 1.00-1.50
Cr: up to 0.60
Si: 0.15-0.35
S+P: about 0.06
balance essentially iron.

2. Process as claimed in claim 1, in which said second temperature is 300°-380° C. and is followed by a third cooling which brings the links to room temperature.

3. Process as claimed in claim 1, in which said second temperature is 180°-250° C. and is followed by a third cooling during which the links are taken to a temperature of 130°-170° C.

4. Process as claimed in claim 3, in which said third cooling is followed by annealing at a temperature of 530°-570° C. for 30-180 minutes.

5. Process as claimed in claim 1, in which said second temperature is 250°-300° C.

6. Process as claimed in claim 5, and then annealing said link at a temperature of 480°-550° C. for 30-120 minutes.

7. Process as claimed in claim 3, and forging the link at several stations of the same press.

8. Process as claimed in claim 1, in which the steel also contains 0.0005-0.003 weight percent of boron.

9. Process as claimed in claim 1, in which the links are raised in temperature from said initial cooling temperature of 720°-830° C. to said temperature of 800°-850° C. at which said links are maintained for 2-3 minutes.

* * * * *